US009086714B2

(12) United States Patent
Liu et al.

(10) Patent No.: US 9,086,714 B2
(45) Date of Patent: Jul. 21, 2015

(54) HIGH-SPEED LDO DRIVER CIRCUIT USING ADAPTIVE IMPEDANCE CONTROL

(75) Inventors: Liu Liu, Germering (DE); Stephan Drebinger, Munich (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 505 days.

(21) Appl. No.: 13/530,305

(22) Filed: Jun. 22, 2012

(65) Prior Publication Data

US 2013/0147447 A1 Jun. 13, 2013

(30) Foreign Application Priority Data

Dec. 12, 2011 (EP) ..... 11193077

(51) Int. Cl.
*G05F 1/565* (2006.01)
*G05F 1/575* (2006.01)
*G05F 3/30* (2006.01)

(52) U.S. Cl.
CPC . *G05F 1/575* (2013.01); *G05F 3/30* (2013.01)

(58) Field of Classification Search
CPC ..... G05F 3/30; G05F 1/575
USPC ..... 323/273, 275–277, 279, 280
See application file for complete search history.

(56) References Cited

U.S. PATENT DOCUMENTS 5,559,424 A 9/1996 Wrathall et al.
6,380,769 B1 * 4/2002 Hall et al. ..... 327/112
6,933,772 B1 * 8/2005 Banerjee et al. ..... 327/541
7,038,431 B2 * 5/2006 Benbrik ..... 323/273
2002/0130646 A1 9/2002 Zadeh et al.
2005/0029995 A1 2/2005 Benbrik
2005/0040807 A1 2/2005 Chen
2005/0057234 A1 3/2005 Yang et al.
2009/0322295 A1 * 12/2009 Scoones et al. ..... 323/282
2012/0212199 A1 8/2012 Amer et al.
2012/0280667 A1 11/2012 Drebinger et al.

FOREIGN PATENT DOCUMENTS

EP 2520998 11/2012
WO WO 2006/083490 8/2006

OTHER PUBLICATIONS

European Search Report 11193077.2-1802/2605102 Mailed: May 23, 2013, Dialog Semiconductor GmbH.

* cited by examiner

*Primary Examiner* — Matthew Nguyen
(74) *Attorney, Agent, or Firm* — Saile Ackerman LLC; Stephen B. Ackerman

(57) ABSTRACT

The present document relates to linear regulators or linear voltage regulators configured to provide a constant output voltage. In particular, the present document relates to driver circuits of low-dropout (LDO) regulators. A driver circuit (300) for driving a pass device (201) of a linear regulator (120) is described. The driver circuit (300) comprises a driver stage (110) adapted to regulate a driver gate (220) for connecting to the gate of the pass device (201); wherein the driver stage (110) comprises a transistor diode (210) having the driver gate (220); and a feedback transistor (305) having a source and a drain coupled to a source and drain of the transistor diode (210); wherein a feedback voltage at the gate of the feedback transistor (305) is regulated based on the output current of the pass device (201).

31 Claims, 4 Drawing Sheets

HIGH-SPEED LDO DRIVER CIRCUIT USING ADAPTIVE IMPEDANCE CONTROL

BACKGROUND

1. Technical Field

The present document relates relates to linear regulators or linear voltage regulators configured to provide a constant output voltage. In particular, the present document relates to driver circuits for low-dropout (LDO) regulators.

2. Background

Low-dropout (LDO) regulators are linear voltage regulators which can operate with small input-output differential voltages. A typical LDO regulator 100 is illustrated in FIG. 1*a*. The LDO regulator 100 comprises an output amplification stage 103, e.g. comprising a field-effect transistor (FET), at the output and a differential amplification stage or differential amplifier 101 (also referred to as error amplifier) at the input. A first input (fb) 107 of the differential amplifier 101 receives a fraction of the output voltage $V_{out}$ determined by the voltage divider 104 comprising resistors R0 and R1. The second input (ref) to the differential amplifier 101 is a stable voltage reference $V_{ref}$ 108 (also referred to as the bandgap reference). If the output voltage $V_{out}$ changes relative to the reference voltage $V_{ref}$, the drive voltage to the output amplification stage, e.g. the power FET, changes by a feedback mechanism called a main feedback loop to maintain a constant output voltage $V_{out}$.

The LDO regulator 100 of FIG. 1*a* further comprises an additional intermediate amplification stage 102 configured to amplify the output voltage of the differential amplification stage 101. As such, an intermediate amplification stage 102 may be used to provide an additional gain within the amplification path. Furthermore, the intermediate amplification stage 102 may provide a phase inversion, thereby implementing a negative feedback mechanism.

In addition, the LDO regulator 100 may comprise an output capacitance $C_{out}$ (also referred to as output capacitor or stabilization capacitor or bypass capacitor) 105 parallel to the load 106. The output capacitor 105 may be used to stabilize the output voltage $T_{out}$ subject to a change of the load 106, in particular subject to a change of the load current $I_{load}$. It should be noted that typically the output current $I_{out}$ at the output of the output amplification stage 103 corresponds to the load current $I_{load}$ through the load 106 of the regulator 100 (apart from typically minor currents through the voltage divider 104 and the AC current through the output capacitor 105). Consequently, the terms output current $I_{out}$ and load current $I_{load}$ are used synonymously, if not specified otherwise.

As such, FIG. 1*a* shows an example block diagram for an LDO regulator 100 with three amplification stages A1, A2, A3 (reference numerals 101, 102, 103, respectively). Where A2 receives signal "out_s1" from A1 and where A3 receives signal "out_s2" from A2. FIG. 1*b* illustrates another block diagram of a LDO regulator 120, wherein the output amplification stage A3 (reference numeral 103) is depicted in more detail. In particular, the pass transistor 201 (also referred to as the "Pass device") and the driver stage (DS) 110 (also referred to as the driver circuit) of the output amplification stage 103 are shown. Pass transistor 201 receives signal "gat_pd" from driver stage 110. Pass transistor 201 in turn is coupled to a supply voltage Vin (Vdd). Typical parameters of an LDO regulator are a supply voltage of 3.6V, an output voltage of 3.3V, and an output current or load current ranging from 1 mA to 100 or 200 mA. Other configurations are possible.

SUMMARY

Linear regulators 120 often comprise a large pass device 201 which exhibits high gate capacitance. In order to reduce the load transient response time and improve the load transient performance, a driver circuit 110 with low output impedance is therefore desired. The present document describes such driver circuits 110 having low output impedance. In particular, the present document describes driver circuits 110 which exhibit a low output impedance even at low load currents $I_{load}$, thereby ensuring the stability of the LDO regulator 120 to load transients at low load currents $I_{load}$ (i.e. even at load currents which are approaching zero).

According to an aspect a driver circuit for driving a pass device of a linear regulator is described. The driver circuit comprises a driver stage adapted to regulate a driver gate for connecting to a gate of the pass device. The driver stage comprises a transistor diode having the driver gate. Typically, the transistor diode comprises a driver transistor comprising the driver gate. The gate of the driver transistor may be coupled to the drain of the driver transistor. As such, the driver transistor may be adapted to form a current mirror with the pass device when the driver gate is connected to the gate of the pass device.

The driver stage of the driver circuit may be adapted to provide a drive voltage to the driver gate, thereby regulating the gate of the pass device, when the pass device is coupled to the driver gate. The drive voltage may be generated at least based on a load (or output) voltage at the pass device. In addition, the drive voltage may be generated based on the load current at the pass device. Typically, the drive voltage is generated using a main feedback loop of the linear regulator. Such a main feedback loop may comprise a voltage divider parallel to a load at the linear regulator and/or parallel to the output of the pass device, thereby sensing the load (or output) voltage. The sensed load voltage may be fed back to an input of the linear regulator, where the sensed load voltage may be compared to a reference voltage. The difference between the reference voltage and the sensed load voltage may be used to regulate the drive voltage at the gate of the driver gate (e.g. using various amplification stages).

The driver circuit further comprises a feedback transistor having a source and a drain coupled to a source and a drain of the transistor diode, respectively. In other words, the feedback transistor is placed in parallel to the transistor diode. The feedback transistor is controlled using a feedback voltage at the gate of the feedback transistor. This feedback voltage is regulated based on an output current of the pass device. The regulation of the feedback voltage may be implemented within a feedback loop having as an input the output current of the pass device and providing at an output the feedback voltage. In other words, the feedback transistor may be part of a feedback loop. The regulation of the feedback voltage may be such that for a low output current (e.g. for an output current which is close to zero or equal to zero, e.g. for an output current at 10 mA or less), the output impedance of the feedback transistor is such that the overall output impedance at the driver gate is reduced. In particular, the feedback loop may be designed such that (for a certain range of the output current e.g. for a low output current below an upper output current threshold) the output impedance of the feedback transistor is lower than the output impedance of the transistor diode. The output impedance of the feedback transistor may be regulated by appropriately selecting the parameters and components of the feedback loop.

The driver circuit (and in particular the feedback loop) may comprise output current sensing means which are adapted to sense the output current of the pass device. In particular, the output current sensing means may comprise an output current mirror transistor having a gate connected to the driver gate. The output current mirror transistor (e.g. the transistor M2 in FIG. 3) may be adapted to form a current mirror with the pass device when the driver gate is connected to the gate of the pass device. As such, the sensed output current may correspond to (or may be proportional to) the output current (e.g. the current at the drain) of the output current mirror transistor.

The driver circuit (and in particular the feedback loop) may comprise output current amplification means adapted to amplify or attenuate the sensed output current, thereby yielding a scaled output current. In particular, the output current amplification means may comprise a current mirror which converts (i.e. amplifies or attenuates) the sensed output current to the scaled output current. Typically, the current mirror of the output current amplification means comprises an input transistor (e.g. the transistor M3 in FIG. 3) of the current mirror and an output transistor (e.g. the transistor M4 in FIG. 3) of the current mirror, wherein the sensed output current corresponds to the output current (e.g. the drain current) of the output transistor.

The driver circuit (and in particular the feedback loop) may comprise feedback voltage generation means adapted to generate the feedback voltage at the gate of the feedback transistor (e.g. the transistor M5 in FIG. 3) based on the scaled output current. In particular, the feedback voltage generation means may comprise a current source adapted to generate a source current. The current source may be coupled to the gate of the feedback transistor. The feedback voltage may then be generated based on the scaled output current and based on the source current (e.g. based on the difference of the scaled output current and the source current).

In order to allow for a varying sensed output current, the feedback voltage generation means may comprise a bypass transistor (e.g. the transistor M6 in FIG. 3) adapted to carry a current which corresponds to a difference of the source current and the scaled output current. The bypass transistor may be placed within the feedback loop such that a drain of the bypass transistor is coupled to an output of the output current amplification means (e.g. an output or drain of the output transistor). Furthermore, a gate of the bypass transistor may be coupled to the gate of the feedback transistor.

The driver circuit (and in particular the feedback loop) may further comprise a cascode transistor (e.g. transistor M7 in FIG. 3). The output of the output current amplification means (e.g. the output of the output transistor) may be coupled to the source of the cascode transistor. Furthermore, the drain of the cascode transistor may be coupled to the current source.

The transistors of the driver circuit may be implemented as field effect transistors, e.g. as PMOS or NMOS transistors.

According to another aspect, a linear regulator is described. The linear regulator comprises a pass device adapted to generate a load current subject to a drive voltage applied to a gate of the pass device. Furthermore, the linear regulator comprises a driver circuit according to any of the aspects and features described in the present document. The driver circuit is adapted to generate the drive voltage to be applied to the gate of the pass device.

It should be noted that the methods and systems including its preferred embodiments as outlined in the present document may be used stand-alone or in combination with the other methods and systems disclosed in this present document. Furthermore, all aspects of the methods and systems outlined in the present document may be arbitrarily combined. In particular, the features of the claims may be combined with one another in an arbitrary manner.

The present invention is explained below in an exemplary manner with reference to the accompanying drawings, wherein

Figure 1A:
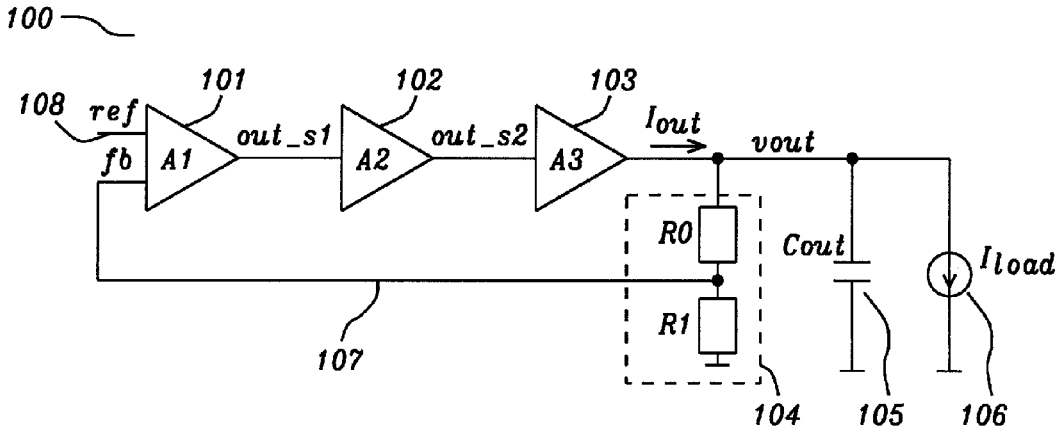
FIG. 1*a* illustrates an example block diagram of an LDO regulator.
Figure 1B:
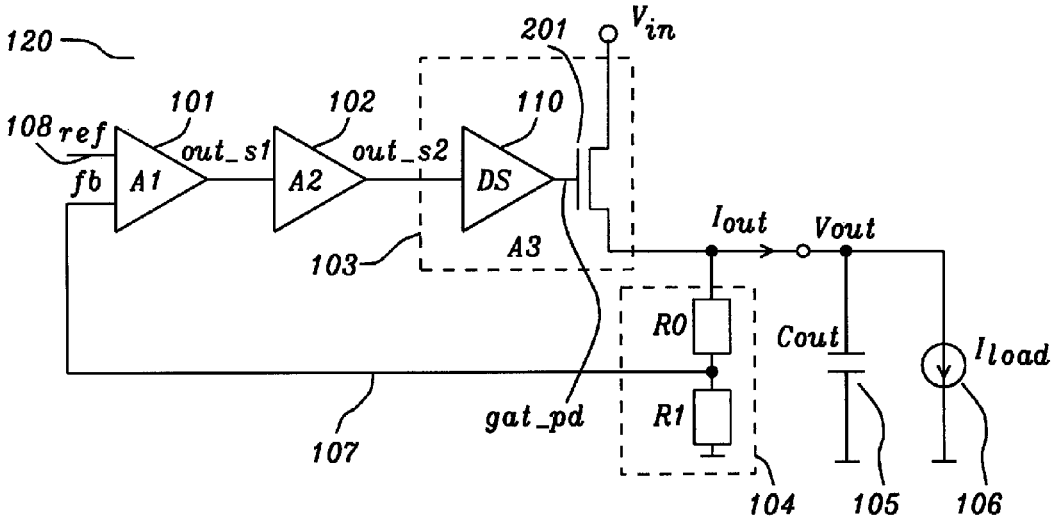
FIG. 1*b* illustrates the example block diagram of an LDO regulator in more detail (in particular, depicting the gate driver stage and the pass device).

As indicated above, linear regulators 120 often comprise a large pass device 201 which exhibits high gate capacitance. In order to reduce the load transient response time and improve the load transient performance, a driver circuit 110 with low output impedance is desirable. Driver circuit 110 is coupled at one end to supply voltage Vdd and to return voltage Vss at the other end. The driver circuit 110 shown in FIG. 2 may be used for such purposes. The driver circuit 110 comprises a MOS diode as load, wherein the MOS diode (210), and labeled "Pgate driver", comprises a transistor M1 (201). The transistor M1 forms a PMOS current mirror with the Pass device 201, where the gates of M1 and Pass device 201 are coupled via Pgate node 220. The Pass device 201 is coupled between supply voltage Vdd and terminal "output".

The driver circuit 210 exhibits low load transient response times. However, the driver circuit 210 may lead to an unstable performance of the linear regulator 120 subject to load transients, in cases where the load current $I_{load}$ is relatively low (tends towards zero, e.g. from zero to several mA). This stability issue can be understood when analyzing the Bode diagram of the linear regulator 120 and in particular of the driver circuit 210.

The frequency of the Bode pole at the Pgate node 220, i.e. at the gates of the pass device 201 and of the transistor M1, can be derived from the formula $$f=\tfrac{1}{2}pR_{Pgate}C_{Pgate}.$$

Here $R_{Pgate}$ is the impedance at the Pgate node 220 and $C_{Pgate}$ is the capacitance at the Pgate node 220. Usually the dominant Bode pole from the previous amplification stages 101, 102 of the LDO regulator 120 already causes a 90° degrees phase shift. In order to achieve sufficient phase margin (e.g. of more than 60° degrees) for the LDO regulator 120 to sustain stability, the frequency of the Bode pole of the Pgate node 220 should be pushed to high frequencies so that the pole of the Pgate node 220 will not cause an additional significant phase shift for frequencies lower than the gain-bandwidth product (at this frequency the gain crosses to zero) of the LDO regulator 120. In other words, the frequency of the Bode pole of the Pgate node 220 should be pushed to high frequencies, in order to ensure that a load transient (comprising high frequency components) does not cause an instability of the LDO regulator 120.

The impedance $R_{Pgate}$ at the Pgate node 220 is approximately given by $1/gm_{M1}$, where the transconductance $g_{mM1}$ of the transistor M1 is given as $$gm_{M1} = \sqrt{2\mu_p C_{ox} I_D \frac{W}{L}}.$$

In the above formula, W and L are the gate width and the gate length of the transistor M1, respectively. $I_D$, i.e. the drain current, is the current flowing through the transistor M1 and corresponds to the mirror current of the load current $I_{load}$. $C_{ox}$ is the gate oxide capacitance per unit area of the transistor M1 and $\mu_p$ is the charge-carrier effective mobility. In view of the fact that the current $I_D$ is proportional to the load current (because M1 and the pass device 201 form a current mirror), it can be seen from the above mentioned formula that at high load current $I_{load}$ (proportional to $I_D$), the transconductance $gm_{M1}$ tends to be high such that the Pgate node 220 has a small impedance $R_{Pgate}$. Consequently, for high load currents $I_{lead}$, the Bode pole of the Pgate node 220 is positioned at high frequencies and the driver circuit 210 (and the overall LDO regulator 120) is typically stable and demonstrates high speed (i.e. a fast adaption) subject to load transients.

However, with decreasing load current (e.g. below several mA), the transconductance $gm_{M1}$ decreases and the impedance $R_{Pgate}$ at the Pgate node 220 increases. Consequently, the frequency of the Bode pole of the Pgate node 220 decreases to lower frequencies. Therefore, the driver circuit 210 of FIG. 2 has the intrinsic drawback of reduced stability to transients at low load current $I_{load}$. Especially at zero load current (or at very small load currents), the current through transistor M1 goes down to several tens or hundreds nA range and the impedance $R_{Pgate}$ at the Pgate node 220 can be in the MΩ range. This results in a low frequency pole which typically poses significant problems for the stability of the driver circuit 210 (and of the LDO regulator 120) at low load current $I_{load}$.

Figure 2:
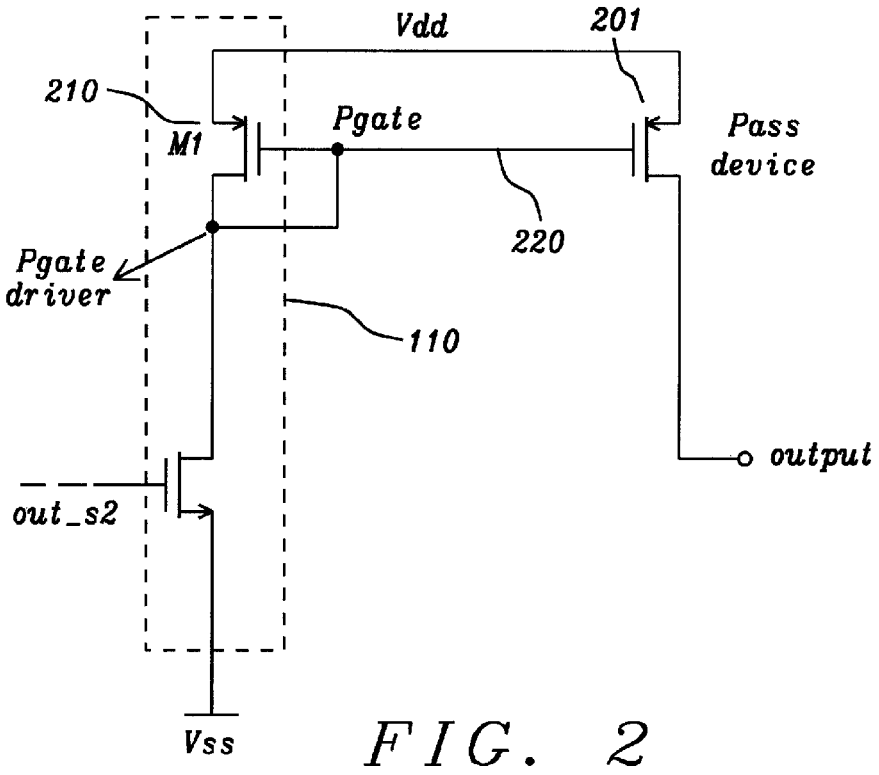
FIG. 2 illustrates an example circuit diagram of a pass gate driver circuit.

Nevertheless, the circuit 210 shown in FIG. 2 may be used as a driver stage for a pass device 201 in an LDO regulator 120, due to the high speed and fast response time of the circuit 210. However, the frequency compensation for the driver circuit 210 at low load current is not sufficiently addressed, i.e. the stability of the driver circuit 210 subject to transients at low load currents is not sufficiently addressed.

DETAILED DESCRIPTION

The present document describes an enhanced driver circuit 300 (see FIG. 3) which maintains the high speed property of the MOS diode driver 210, but which at the same time solves the above mentioned stability problem at low load current.

Figure 3:
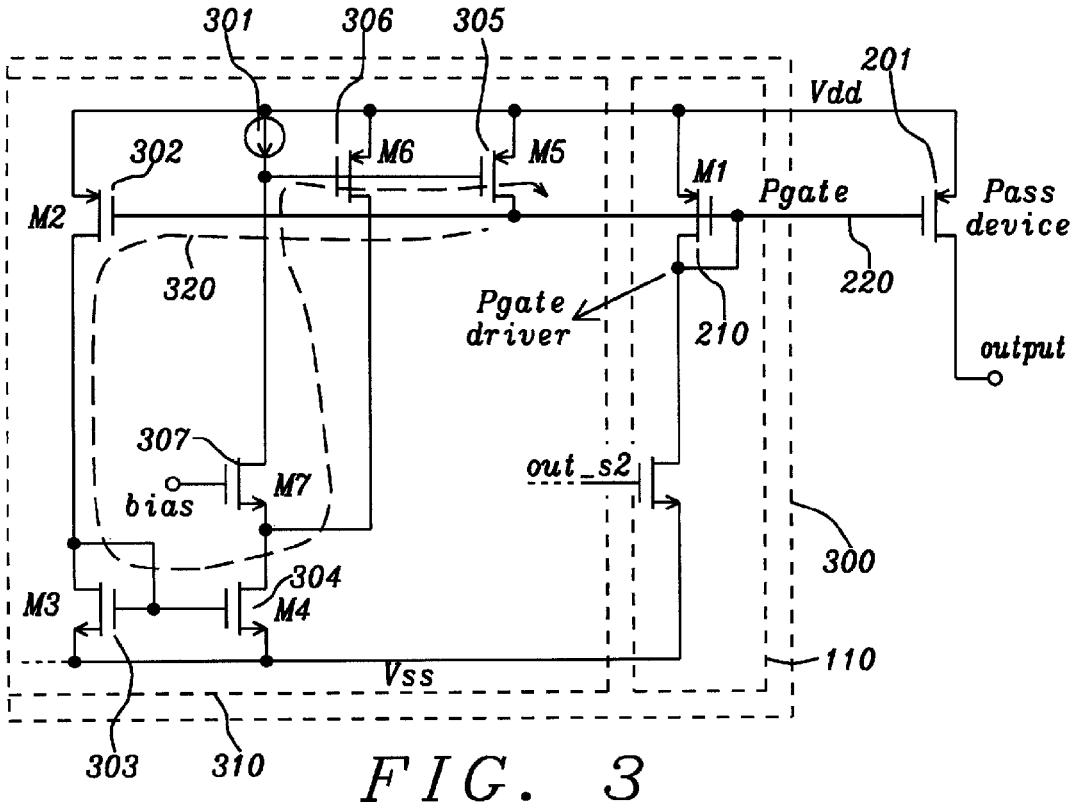
FIG. 3 illustrates an example circuit diagram of a pass gate driver circuit using adaptive impedance control.

FIG. 3 illustrates an example driver circuit 300 which addresses the above mentioned stability problem of the driver circuit 210. In particular, FIG. 3 illustrates a circuit 310 comprising a plurality of transistors M2 to M5 which may be used to reduce the impedance of the Pgate node 220 at low load current. The transistor M2 (reference numeral 302) is a mirror transistor of the transistor M1 and of the pass device 201. This means that the transistor M2 forms a current mirror in conjunction with the pass device 201.

A current mirror typically provides a current at the mirror transistor (e.g. the transistor M2) which is proportional to the current at the input transistor (e.g. the pass device 201). The proportionality factor is given by an amplification ratio of 1/M (<1). The current mirror of FIG. 3 comprises a first transistor 201 (the pass device) and a second transistor 302 (i.e. transistor M2). The current at the first transistor 201 corresponds to the load current $I_{load}$, wherein the current at the second transistor 302 corresponds to the output current $I_{load}$ reduced by the factor M. The gain (or attenuation) value or factor M typically depends on the dimensions of the first and/or second transistor. If the first transistor 201 is referred to as N1 and the second transistor 302 is referred to as N2, the gain factor $$M = \frac{W_{N1}}{L_{N1}} \frac{L_{N2}}{W_{N2}},$$

wherein $$\frac{W_{N1}}{L_{N1}}$$

is a width to length ratio of the first transistor N1 and $$\frac{W_{N2}}{L_{N2}}$$

is a width to length ratio of the second transistor N2.

Consequently, the load current is mirrored (in a proportional manner) to M2. The mirrored current at M2 is then transferred through an additional NMOS current mirror given by the transistor M3 (reference numeral 303) and the transistor M4 (reference numeral 304). As such, the output current of transistor M4 is proportional to the load current $I_{load}$. This output current of transistor M4 is compared with the current of a current source 301, in order to regulate the gate of the common source transistor M5 (reference numeral 305). In other words, the potential at the gate of the transistor M5 is regulated through means of the output current of transistor M4 and the current provided by the current source 301. The output of the transistor M5 is again fed to the Pgate node 220. Overall, the arrangement of transistors M2-M5 forms a negative feedback loop (also referred to as a compensation circuit) 310 which regulates the Pgate node 220. The output impedance of this loop at transistor M5 can be represented as $$r_{outclosedloop} = \frac{r_{oM5}}{G_{openloop}}, \quad (1)$$

where $r_{outclosedloop}$ is the output impedance of the compensation circuit 310 comprising the transistors M2-M5 and the current source 301. $r_{oM5}$ is the output impedance of transistor M5 itself and $G_{openloop}$ is the open loop gain formed by transistors M2, M3, M4 and M5, i.e. formed by the feedback loop 310.

As indicated above, the current of transistor M2 is proportional to the load current. Due to the fact that the load current is varying, the feedback loop 310 provided by transistors M2-M5 would not be able to keep regulating if M4 is biased by the constant current source 301. In other words, the constant current provided by the current source 301 would prevent current variations at the transistor M4, thereby blocking the regulation of the feedback loop 310 provided by the transistors M2-M5. For this purpose, transistor M6 (reference numeral 306) is added to allow for a varying current at transistor M4 and to thereby keep the feedback loop 310 working.

Furthermore, the driver circuit 300 of FIG. 3 comprises a cascode transistor M7 (reference numeral 307) (The word "cascode" is a contraction of the expression "cascade to cathode"). The cascode transistor M7 is used to avoid a shortening between the gate and drain of the transistor M6. If this were the case, M6 would become a transistor diode instead of a regulating transistor providing the current for the transistor M4.

The overall functionality of the feedback loop 310 is illustrated by the arrow 320. It can be seen that the load current $I_{load}$ is sensed using the current mirror formed by the transistor M2 and the pass device 201. The sensed load current is amplified or attenuated using a further current mirror formed by the transistors M3 and M4. As a consequence, the drain current of the transistor M4 is proportional to the load current $I_{oad}$. The drain current of the transistor M4 is compared to a constant source current provided by the current source 301. In other words, the drain current of the transistor M4 is subtracted by the constant current provided by the current source 301. The transistor M6 is used to inject a current which corresponds to the difference between the constant source current and the drain current of transistor M4, in order to enable the feedback loop 310 to cope with varying load currents $I_{load}$. Furthermore, a cascode transistor M7 may be used to improve the speed of the transistor M4. The drain of the transistor M4 (or the drain of the cascode transistor M7) is coupled to the current source 301 and to the gate of the transistor M5. The potential which is generated at the gate of the transistor M5 as a result of the drain current of M4 and the constant source current is used to control the output voltage of transistor M5 (i.e. to control the drive voltage provided by the feedback loop 310).

The total gain of the feedback loop 310, i.e. the open look gain $G_{openloop}$, may be approximated by $$G_{openloop} \approx G_{M2} \cdot G_{M4} \cdot G_{M7} G_{M5},$$

wherein $G_{M2}$, $G_{M4}$, $G_{M7}$ and $G_{M5}$ represent the gains provided by each stage of the feedback loop 310. The gains of the individual stages can be further written as:

$$G_{M2} \approx g_{mM2} \cdot \frac{1}{g_{mM3}};$$

$$G_{M4} \approx g_{mM4} \cdot r_{M4};$$

$$G_{M7} \approx \frac{g_{mM7} \cdot r_{M7}}{1 + g_{mM7} \cdot r_{M7} \cdot g_{mM6} \cdot r_{M6}}; \text{ and}$$

$$G_{M5} \approx g_{mM5} \cdot r_{M5}.$$

For simplicity reason, the output impedance at the output node of each gain stage is denoted in the above equations as $r_{Mx}$ (x=2, 4, 5, 6, 7). The parameters $gm_{Mx}$ represent the transconductance of the corresponding transistor Mx (x=2, 3, 4, 5, 6, 7).

The resulting impedance at Pgate node 220, i.e. the total impedance resulting from the output impedance of the transistor M1 and the output impedance of the feedback loop 310, is given by $$R_{Pgate} \approx \frac{1}{g_{mM1}} \| r_{outclosedloop}.$$

This means that the resulting impedance at Pgate node 220 is given by the output impedance $$r_{outM1} \approx \frac{1}{g_{mM1}}$$

of the transistor M1 in parallel to the output impedance of the compensation circuit $r_{outclosedloop}$. The closed loop output impedance $r_{outclosedloop}$ can be designed to be low, such that the total impedance of the Pgate node 220 is significantly reduced and not limited by the output impedance $1/g_{mM1}$ of the transistor M1. In particular, as can be seen from equation (1), the output impedance of the feedback loop 310 at the transistor M5 can be made small by designing an open loop gain $G_{openloop}>1$. In other words, the parameters of the feedback loop 310 can be adjusted to tune the output impedance of the feedback loop 310 at the transistor M5 to a desired value. In particular, $r_{outclosedloop}$ can be tuned to be significantly smaller than the default output impedance of the transistor M5, i.e. $r_{oM5}$.

As a result, the frequency of the Bode pole at the Pgate node 220, which is given by $\frac{1}{2}pR_{Pgate}C_{Pgate}$, can be kept high, even at low load currents $I_{load}$, thereby ensuring the stability of the LDO regulator 120 subject to transients of the load, even at low load current $I_{load}$.

Figure 4:
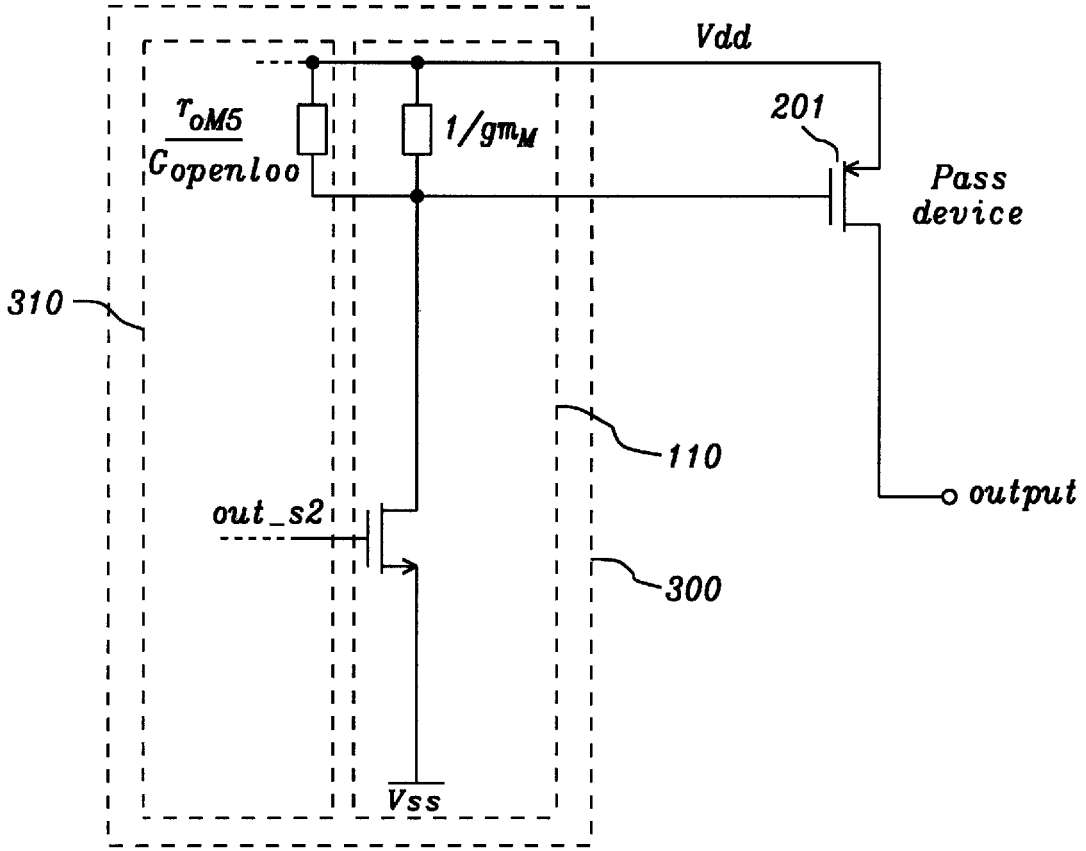
FIG. 4 shows an example simplified small signal diagram illustrating the function of the circuit diagram of FIG. 3.

FIG. 4 illustrates the function of the driver circuit 300 of FIG. 3. It can be seen that the transistor 305 including the feedback loop 310 can be viewed as an impedance of $$r_{outclosedloop} = \frac{r_{oM5}}{G_{openloop}}$$

which is placed in parallel to the output impedance of the transistor diode 210 of the driver stage 110, i.e.

$$r_{outM1} \approx \frac{1}{g_{mM1}}.$$

By appropriately designing the feedback loop 310, the output impedance of the feedback loop can be made significantly smaller than the output impedance of the transistor diode 210, thereby reducing the overall output impedance of the driver circuit 300.

Figure 5:
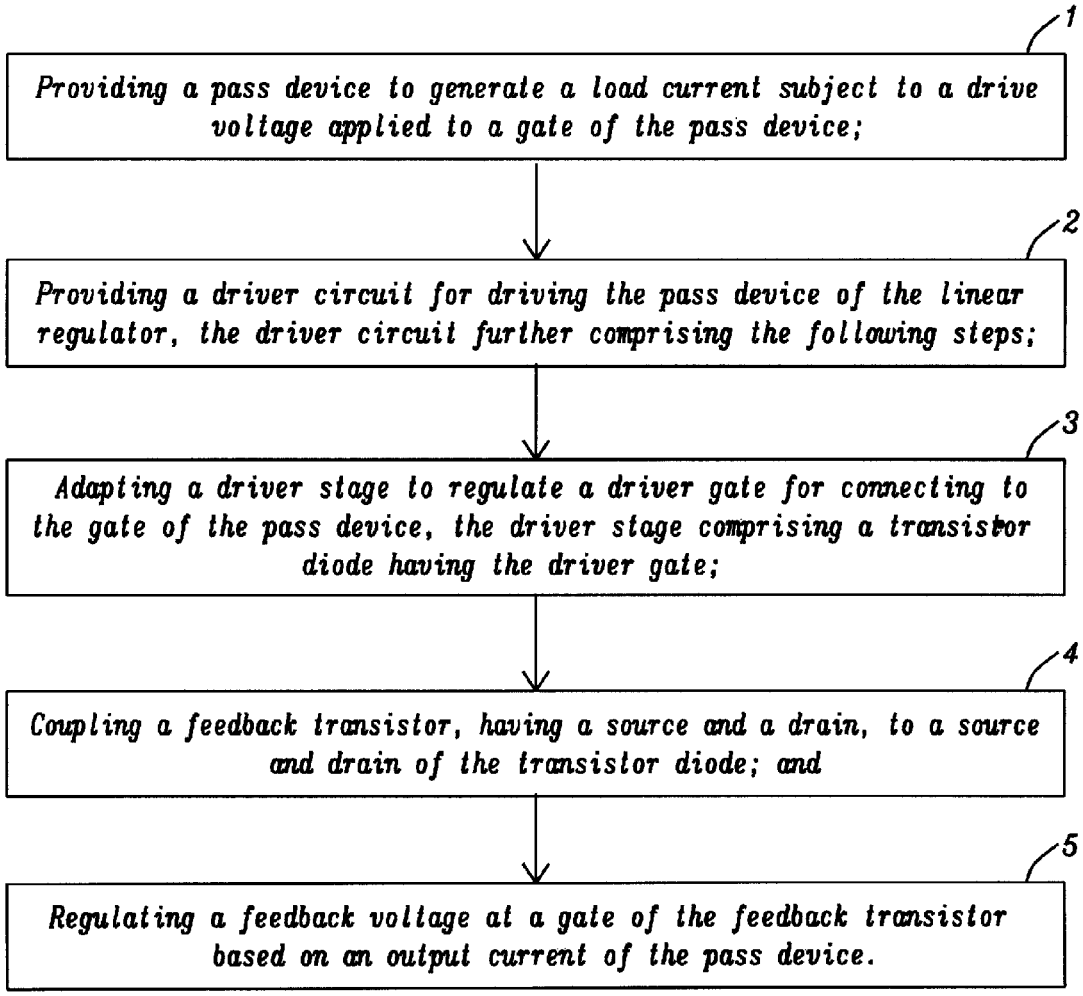
FIG. 5 is a block diagram of the method of the present invention.

We now describe the method of the present document with reference to the block diagram of FIG. 5:

Block 1 provides a pass device to generate a load current subject to a drive voltage applied to a gate of the pass device;

Block 2 provides a driver circuit for driving the pass device of the linear regulator, the driver circuit further comprising the following steps:

Block 3 adapts a driver stage to regulate a driver gate for connecting to the gate of the pass device, the driver stage comprising a transistor diode having the driver gate;

Block 4 couples a feedback transistor, having a source and a drain, to a source and drain of the transistor diode; and Block 5 regulates a feedback voltage at a gate of the feedback transistor based on an output current of the pass device.

In the present document, a driver circuit for the pass device of a linear regulator has been described. The driver circuit makes use of a regulation loop in order to lower the impedance at the driving gate of the pass device, even for load currents which are very low. In other words, the impedance at the driving gate is automatically reduced when needed by use of a regulation loop. This ensures the stability of the linear regulator (subject to transients) even at load currents which tend towards zero.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A driver circuit for driving a pass device of a linear regulator, the driver circuit comprising a driver stage adapted to regulate a driver gate for connecting to a gate of the pass device, wherein the driver stage comprises a transistor diode having the driver gate;

a feedback transistor having a source and a drain coupled to a source and a drain of the transistor diode; wherein a feedback voltage at a gate of the feedback transistor is regulated based on an output current of the pass device; and output current sensing means adapted to sense the output current of the pass device;

wherein the output current sensing means comprise an output current mirror transistor having a gate connected to the driver gate; wherein the output current mirror transistor is adapted to form a current mirror with the pass device when the driver gate is connected to the gate of the pass device; and the sensed output current of the pass device corresponds to an output current of the output current mirror transistor.

2. The driver circuit of claim 1, wherein the feedback voltage is regulated such that at low output current an output impedance of the feedback transistor is lower than an output impedance of the transistor diode.

3. The driver circuit of claim 1, further comprising output current amplification means adapted to amplify the sensed output current of the pass device, thereby yielding a scaled output current.

4. The driver circuit of claim 3, wherein the output current amplification means comprise a current mirror which converts the sensed output current of the pass device to the scaled output current; and the current mirror comprises an input transistor and an output transistor.

5. The driver circuit of claim 3, further comprising feedback voltage generation means adapted to generate the feedback voltage at the gate of the feedback transistor based on the scaled output current.

6. The driver circuit of claim 5, wherein the feedback voltage generation means comprise a current source adapted to generate a source current, the current source coupled to the gate of the feedback transistor; and the feedback voltage is generated based on the scaled output current and based on the source current.

7. The driver circuit of claim 6, wherein the feedback voltage generation means comprises:

a bypass transistor adapted to carry a current which corresponds to a difference between the source current and the scaled output current.

8. The driver circuit of claim 7, wherein a drain of the bypass transistor is coupled to an output of the output current amplification means; and/or a gate of the bypass transistor is coupled to the gate of the feedback transistor.

9. The driver circuit of claim 8, wherein the driver circuit further comprises a cascode transistor;

the output of the output current amplification means is coupled to a source of the cascode transistor; and a drain of the cascode transistor is coupled to the current source.

10. The driver circuit of claim 1, wherein the driver stage is adapted to provide a drive voltage to the driver gate; and the drive voltage is generated based at least on an output voltage at the pass device.

11. The driver circuit of claim 1, wherein the transistor diode comprises a driver transistor comprising the driver gate; and the driver transistor is adapted to form a current mirror with the pass device when the driver gate is connected to the gate of the pass device.

12. The driver circuit of claim 1, wherein transistors of the driver circuit are implemented as field effect transistors.

13. The driver circuit of claim 1, further comprising output current amplification means adapted to attenuate the sensed output current of the pass device, thereby yielding a scaled output current.

14. A linear regulator comprising a pass device adapted to generate a load current subject to a drive voltage applied to a gate of the pass device;

a driver circuit for driving the pass device of the linear regulator, the driver circuit further comprising:

a driver stage adapted to regulate a driver gate for connecting to the gate of the pass device, wherein the driver stage comprises a transistor diode having the driver gate; and a feedback transistor having a source and a drain coupled to a source and a drain of the transistor diode; wherein a feedback voltage at a gate of the feedback transistor is regulated based on an output current of the pass device; and output current sensing means adapted to sense the output current of the pass device;

wherein the output current sensing means comprise an output current mirror transistor having a gate connected to the driver gate; wherein the output current mirror transistor is adapted to form a current mirror with the pass device when the driver gate is connected to the gate of the pass device; and the sensed output current of the pass device corresponds to an output current of the output current mirror transistor.

15. The linear regulator of claim 14, wherein the feedback voltage is regulated such that at low output current an output impedance of the feedback transistor is lower than an output impedance of the transistor diode.

16. The linear regulator of claim 14, further comprising output current amplification means adapted to amplify the sensed output current of the pass device, thereby yielding a scaled output current.

17. The linear regulator of claim 16, wherein the output current amplification means comprise a current mirror which converts the sensed output current of the pass device to the scaled output current; and the current mirror comprises an input transistor and an output transistor.

18. The linear regulator of claim 16, further comprising feedback voltage generation means adapted to generate the feedback voltage at the gate of the feedback transistor based on the scaled output current.

19. The linear regulator of claim 18 wherein the feedback voltage generation means comprise a current source adapted to generate a source current, the current source coupled to the gate of the feedback transistor; and the feedback voltage is generated based on the scaled output current and based on the source current.

20. The linear regulator of claim 19, wherein the feedback voltage generation means comprises:

a bypass transistor adapted to carry a current which corresponds to a difference between the source current and the scaled output current.

21. The linear regulator of claim 20, wherein a drain of the bypass transistor is coupled to an output of the output current amplification means; and/or a gate of the bypass transistor is coupled to the gate of the feedback transistor.

22. The linear regulator of claim 21, wherein the driver circuit further comprises a cascode transistor;

the output of the output current amplification means is coupled to a source of the cascode transistor; and a drain of the cascode transistor is coupled to the current source.

23. The linear regulator of claim 14, wherein the driver stage is adapted to provide a drive voltage to the driver gate; and the drive voltage is generated based at least on an output voltage at the pass device.

24. The linear regulator of claim 14, wherein the transistor diode comprises a driver transistor comprising the driver gate; and the driver transistor is adapted to form a current mirror with the pass device when the driver gate is connected to the gate of the pass device.

25. The linear regulator of claim 14, wherein transistors of the driver circuit are implemented as field effect transistors.

26. The linear regulator of claim 14, further comprising output current amplification means adapted to attenuate the sensed output current of the pass device, thereby yielding a scaled output current.

27. A method of providing a linear regulator configured to provide a constant output voltage, comprising the steps of:

a) providing a pass device to generate a load current subject to a drive voltage applied to a gate of the pass device;

b) providing a driver circuit for driving the pass device of the linear regulator, the driver circuit further comprising the following steps:

c) adapting a driver stage to regulate a driver gate for connecting to the gate of the pass device, the driver stage comprising a transistor diode having the driver gate;

d) coupling a feedback transistor, having a source and a drain, to a source and a drain of the transistor diode;

e) sensing the output current of the pass device using output current sensing means;

wherein the output current sensing means comprise an output current mirror transistor having a gate connected to the driver gate; wherein the output current mirror transistor is adapted to form a current mirror with the pass device when the driver gate is connected to the gate of the pass device; and the sensed output current of the pass device corresponds to an output current of the output current mirror transistor; and f) regulating a feedback voltage at a gate of the feedback transistor based on an output current of the pass device.

28. The method of providing a linear regulator configured to provide a constant output voltage of claim 27, wherein the feedback voltage is regulated such that that at low output current an output impedance of the feedback transistor is lower than an output impedance of the transistor diode.

29. The method of providing a linear regulator configured to provide a constant output voltage of claim 27, further comprising an output current amplifier amplifying the sensed output current of the pass device, thereby yielding a scaled output current.

30. The method of providing a linear regulator configured to provide a constant output voltage of claim 29, wherein the output current amplifier comprises a current mirror which converts the sensed output current of the pass device to the scaled output current.

31. The method of providing a linear regulator configured to provide a constant output voltage of claim 29, wherein a feedback voltage generator generates the feedback voltage at the gate of the feedback transistor based on the scaled output current, wherein the feedback voltage generated is based on the scaled output current.

* * * * *